US007118310B2

(12) United States Patent
Wallstein et al.

(10) Patent No.: US 7,118,310 B2
(45) Date of Patent: Oct. 10, 2006

(54) TRUSS SHOE FOR A MINE ROOF AND METHOD

(75) Inventors: Alexander I. Wallstein, Salt Lake City, UT (US); Roland Walker, Syracuse, UT (US)

(73) Assignee: Dywidag-Systems International, U.S.A., Inc., Bolingbrook, IL (US)

( * ) Notice: Subject to any disclaimer, the term of this patent is extended or adjusted under 35 U.S.C. 154(b) by 295 days.

(21) Appl. No.: 10/725,895

(22) Filed: Dec. 2, 2003

(65) Prior Publication Data

US 2005/0115188 A1 Jun. 2, 2005

(51) Int. Cl.
*E21D 21/00* (2006.01)

(52) U.S. Cl. ..... 405/288; 405/302.1; 405/302.2

(58) Field of Classification Search ..... 405/259.1, 405/288, 302.1, 302.2
See application file for complete search history.

(56) References Cited

U.S. PATENT DOCUMENTS 4,596,496 A * 6/1986 Tyrell et al. ..... 405/288
4,749,310 A * 6/1988 White ..... 405/288
4,934,873 A * 6/1990 Calandra, Jr. ..... 405/288
5,026,217 A * 6/1991 Seegmiller ..... 405/288
5,176,473 A * 1/1993 Seegmiller ..... 405/288
5,238,329 A 8/1993 Long et al. ..... 405/288
5,302,056 A * 4/1994 Calandra et al. ..... 405/288
5,544,982 A * 8/1996 Seegmiller ..... 405/288
5,913,641 A * 6/1999 Long ..... 405/302.2
6,884,005 B1 * 4/2005 Seegmiller ..... 405/288

FOREIGN PATENT DOCUMENTS

CA 2313933 * 1/2001

* cited by examiner

*Primary Examiner*—Frederick L. Lagman
(74) *Attorney, Agent, or Firm*—Marshall, Gerstein & Borum LLP

(57) ABSTRACT

A truss shoe for use on a mine roof truss having at least one inclined bolt and at least one horizontal cross member comprises a base including a first end, a second end, a first side and a second side extending between the first and second ends, a generally planar bearing surface, and a top side disposed opposite the bearing surface, the bearing surface arranged for contact with the mine roof. A stanchion is formed on the top side and includes a bore extending from a top end of the stanchion through the bearing surface, the bore sized to receive the inclined bolt. A bracket is formed on the top side and includes a laterally extending slotted bore sized to receive the horizontal bolt. A portion of the first end and a portion of the first side cooperate to form a curved edge.

34 Claims, 11 Drawing Sheets

TRUSS SHOE FOR A MINE ROOF AND METHOD

FIELD OF THE INVENTION

The present invention relates generally mine roof trusses and, more particularly, to a truss bracket or truss shoe for use with inclined bar bolts for forming a roof truss in an underground mine.

BACKGROUND OF THE INVENTION

In mining operations, bolts are often used to support the roof of the mine. In some applications, a pair of spaced apart inclined bar bolts are anchored into the roof of the mine. Each inclined bar bolt is connected to a truss shoe, also called a truss bracket. The truss shoes, which also are spaced apart due to their connection to the inclined bar bolts, are joined together by a horizontally extending coupler. Typically, the coupler consists of a pair of threaded rods, each connected to a corresponding one of the truss shoes, with the threaded rods and joined to each other by a coupler disposed between the spaced apart truss shoes.

Certain considerations may be faced when installing a mine roof truss. For example, the inclined bar bolts are typically installed, with the truss shoe already attached, using a bolting machine. In some circumstances, the operator may have to leave the bolting machine to adjust the truss shoe or otherwise re-position the truss shoe during the bolting operation. Further, the some inclined bar bolts have hex-head ends, while others are threaded. Typically, a truss shoe is adapted for attachment to a particular type of inclined bar bolt. Moreover, the truss shoe typically is adapted for attachment to a particular type of horizontal cross member, such as a dead-ended, pre-seated wedge barrel attached to a threaded cable, or to a bar cross member having an anchor nut.

DETAILED DESCRIPTION OF THE PREFERRED EMBODIMENT

The example described herein is not intended to be exhaustive or to limit the scope of the invention to the precise form or forms disclosed. Rather, the following exemplary embodiment has been chosen and described in order to best explain the principles of the invention and to enable others skilled in the art to follow the teachings thereof.

Figure 1:
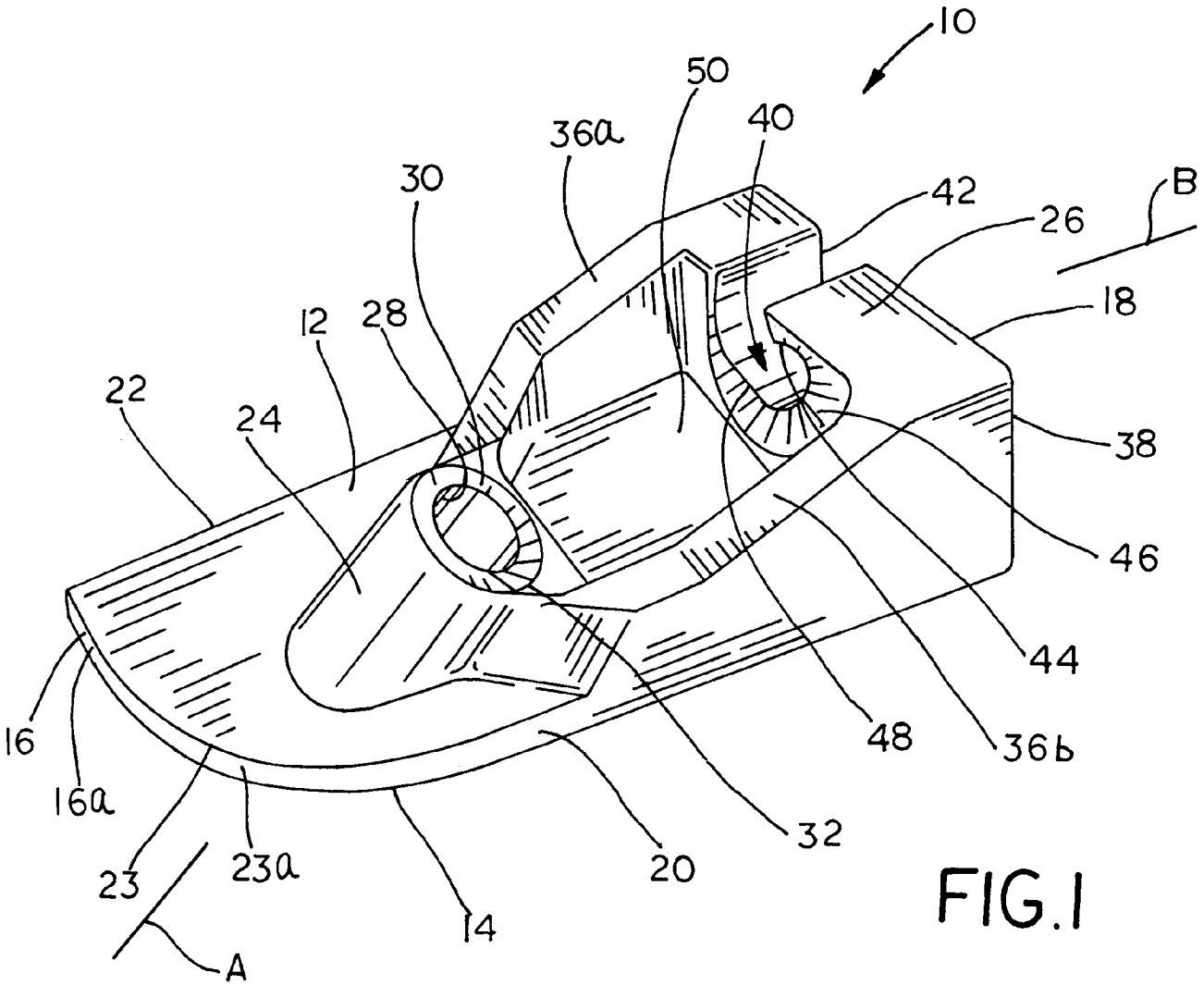
FIG. 1 is a perspective view of a truss shoe for a mine roof assembled in accordance with the teachings of a disclosed example of the present invention.
Figure 2:
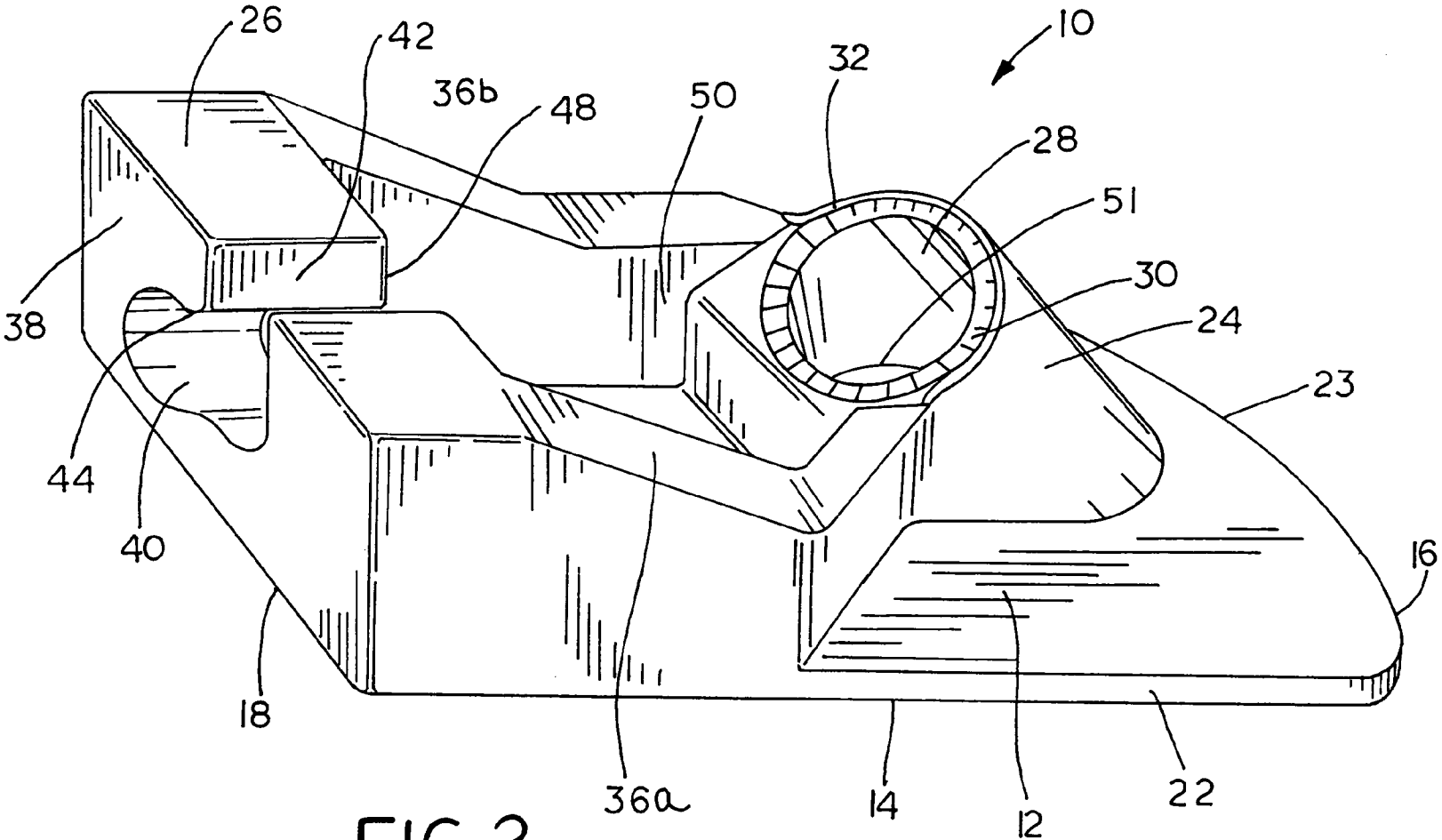
FIG. 2 is an enlarged perspective view of the truss shoe off FIG. 1 taken from the other side.
Figure 3:
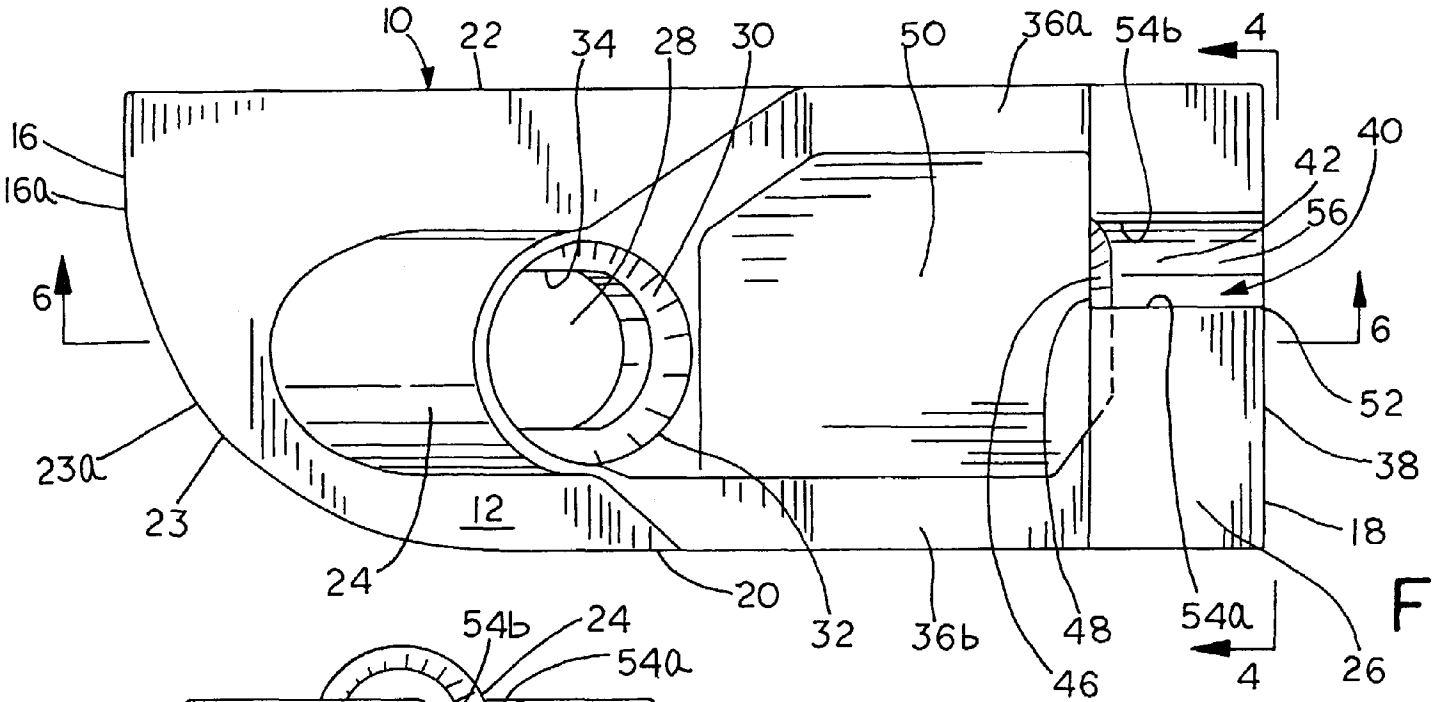
FIG. 3 is a top plan view thereof.

Referring now to FIGS. 1–3 of the drawings, a truss bracket or truss shoe assembled in accordance with the teachings of the present invention and for use in a mine roof truss is shown and is generally referred to by the reference 10. The truss shoe 10 includes a top side 12, a generally planar bottom side 14, a pair of ends 16, 18, and a pair of sides 20, 22. For purposes of the following discussion, the terms "top" and "bottom" are used to refer to elements of the truss shoe 10 when the truss shoe 10 is disposed as shown in FIGS. 1–6. It will be understood that when the truss shoe 10 is used in a mine roof truss as will be explained in greater detail below and as shown in FIGS. 7–10, the bottom side 14 will face generally upward and will be in abutting contact with the roof of the mine. In the disclosed example, the end 16 and the side 20 meet along a generally curved transition 23. The end 16 includes a face or edge 16*a*, while the curved transition 23 includes a face or edge 23*a*.

A stanchion 24 and a retaining bracket 26 are formed on the top side 12 of the truss shoe 10. The stanchion 24 includes a bore 28. The bore 28 includes a seat 30 formed adjacent an upper end 32 of the bore 28, and the bore 28 extends through the bottom side 14 to form a slot 34 (best visible in FIGS. 6 and 7) formed in the bottom side 14 of the shoe 10. It will be appreciated that the stanchion 24 and hence the bore 28 are disposed at an angle relative to the generally planar bottom side 14.

Figure 4:
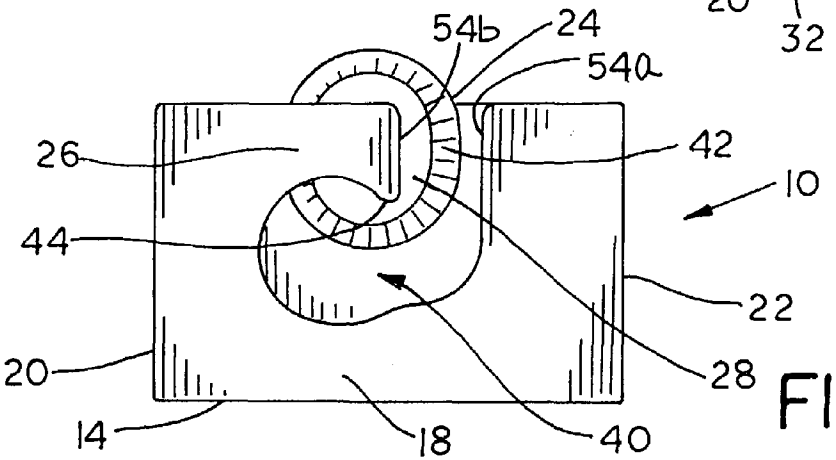
FIG. 4 is a right to side elevation all view taken along line 4—4 all of FIG. 3.

The retaining bracket 26 is formed by a pair of spaced apart walls 36*a*, 36*b* which extend generally from the stanchion toward an end wall 38. The end wall 38 includes a J-shaped bore 40. The J-shaped bore 40 includes an opening or slot 42 formed in the end wall 38. The bore 40 may also include a retaining lip 44 (FIG. 4). A recessed seat 46 is formed adjacent an inner end 48 of the bore 40. A space 50 is defined between the stanchion 24 and the end wall 38, with the space 50 bounded, at least in part, by the walls 36*a* and 36*b*.

The bore 28 includes an axis generally referred to by the reference arrow A, while the bore 40 includes an axis generally referred to by the reference arrow B. The axis A is disposed at an angle relative to a plane of the bottom side 14 of the shoe 10 and, preferably, will be disposed so as to roughly approximate the angle of an inclined roof bolt disposed in the roof of the mine as will be discussed in greater detail below. The axis B is disposed generally parallel to the plane of the bottom side 14 of the shoe 10.

Figure 5:
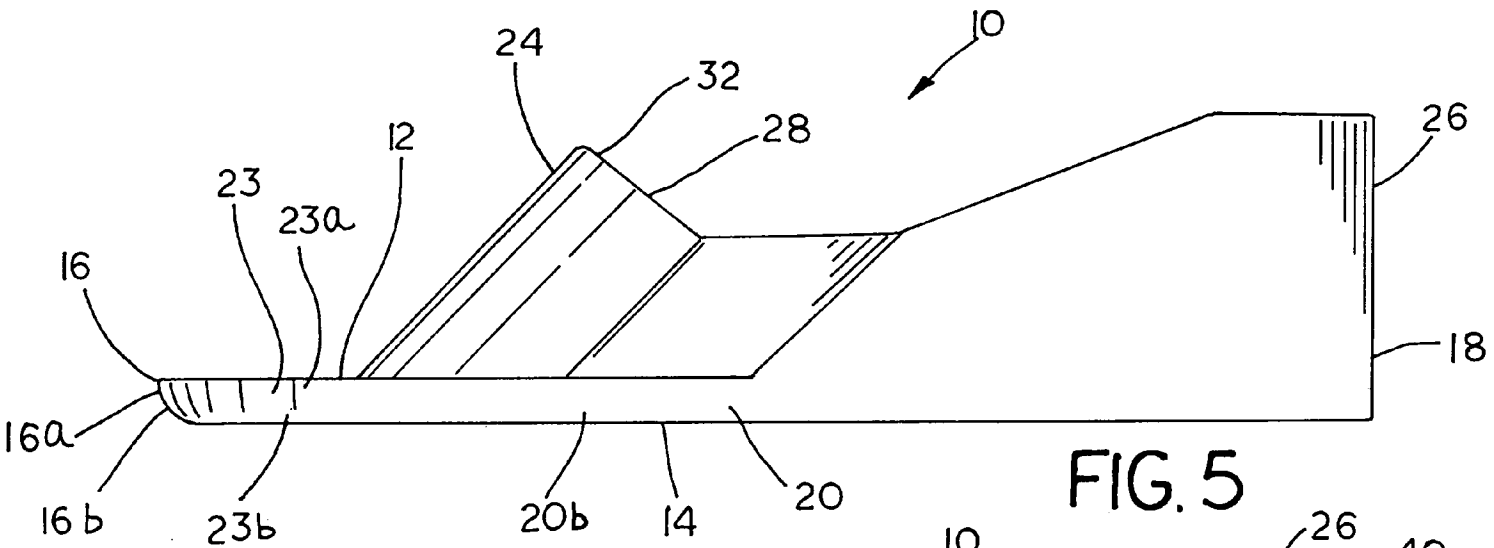
FIG. 5 is a front side elevational view of the truss shoe.
Figure 6:
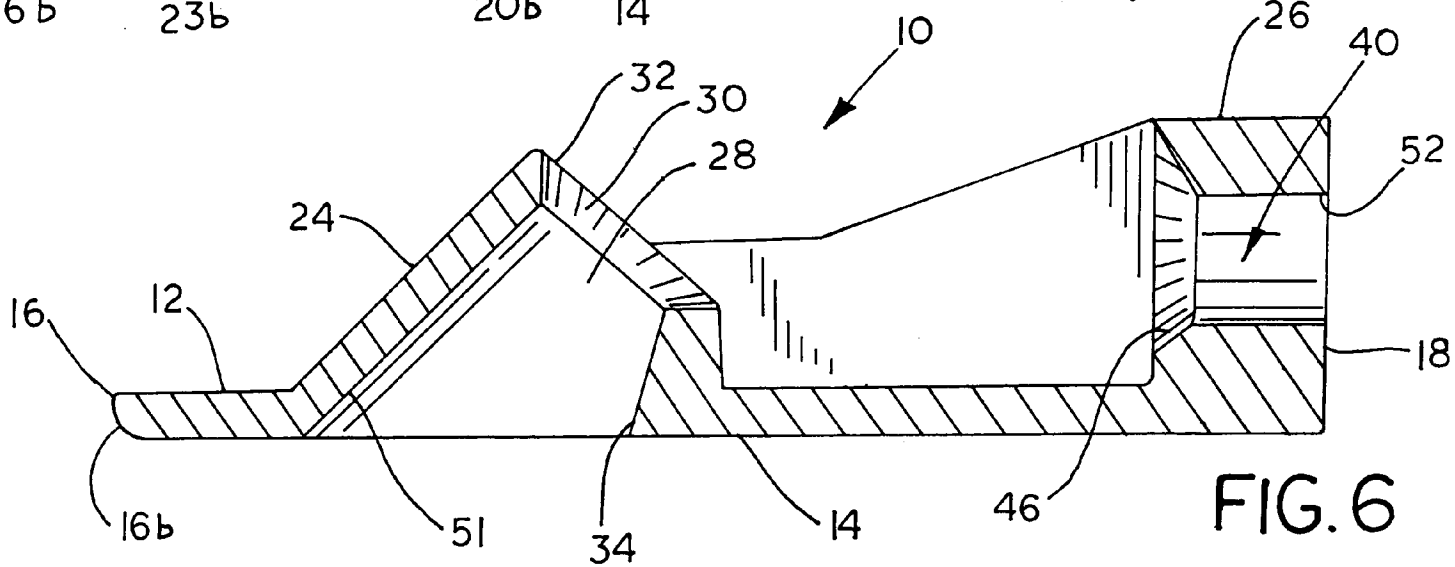
FIG. 6 is a cross-sectional view taken along line 6—6 of FIG. 3.

Referring now to FIG. 5, in the disclosed example, the edge 20*a* and the edge 23*a* both preferably include an angle or chamfer, 20*b* and 23*b*, respectively. The edge 16*a* may also include a chamfer 16*b* (FIGS. 5 and 6). As shown in FIG. 6, the seat 30 of the bore 28 is recessed relative to the upper end 32 of the bore 28. Preferably, the seat 30 will have a generally conical or a generally spherical shape. Also, the bore 28 widens and expands as the bore 28 proceeds from the upper end 32 toward a lower end 51, with the bore 28 terminating in the slot 34 (FIG. 6) formed in the bottom side 14 of the shoe 10. Referring to FIG. 6, the J-shaped bore 40 is shown toward the right side of the drawing, with the bore 40 extending from the seat 46 to an end 52. Preferably, the seat 46 will have a generally conical or a generally spherical shape.

Referring now to FIGS. 3 and 4, the slot 42 of the J-shaped bore 40 is defined, at least in part, by a pair of edges or faces 54*a*, 54*b* defined in the end wall 38 of the retaining bracket 26. The faces 54*a* and 54*b* cooperate to define a gap 56. The gap 56 is sized to receive the shank of a horizontal bolt as will be explained in greater detail below. Further, it will be understood that the gap 56 and the space 50 are sized to permit the horizontal bolt having an attached head to be mounted to the truss shoe 10 as will be explained below. Further, with it will be understood that the space 50 is sized to receive the head attached to the horizontal bolt.

Figure 7:
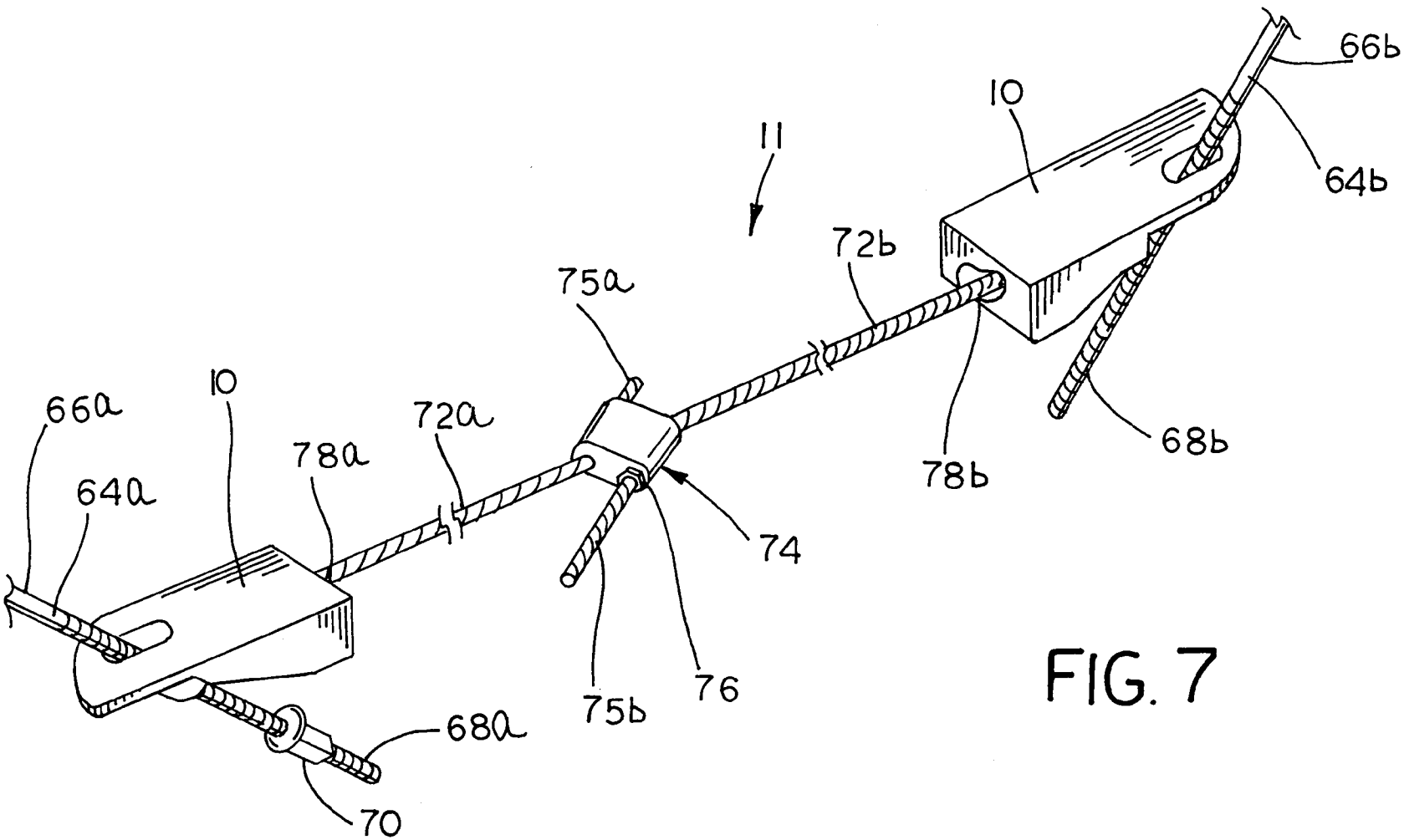
FIG. 7 is a perspective view of an assembled world to truss employing a pair of spaced apart truss shoe is assembled in accordance with the teachings of the present invention and joined apart by a central coupler.
Figure 8:
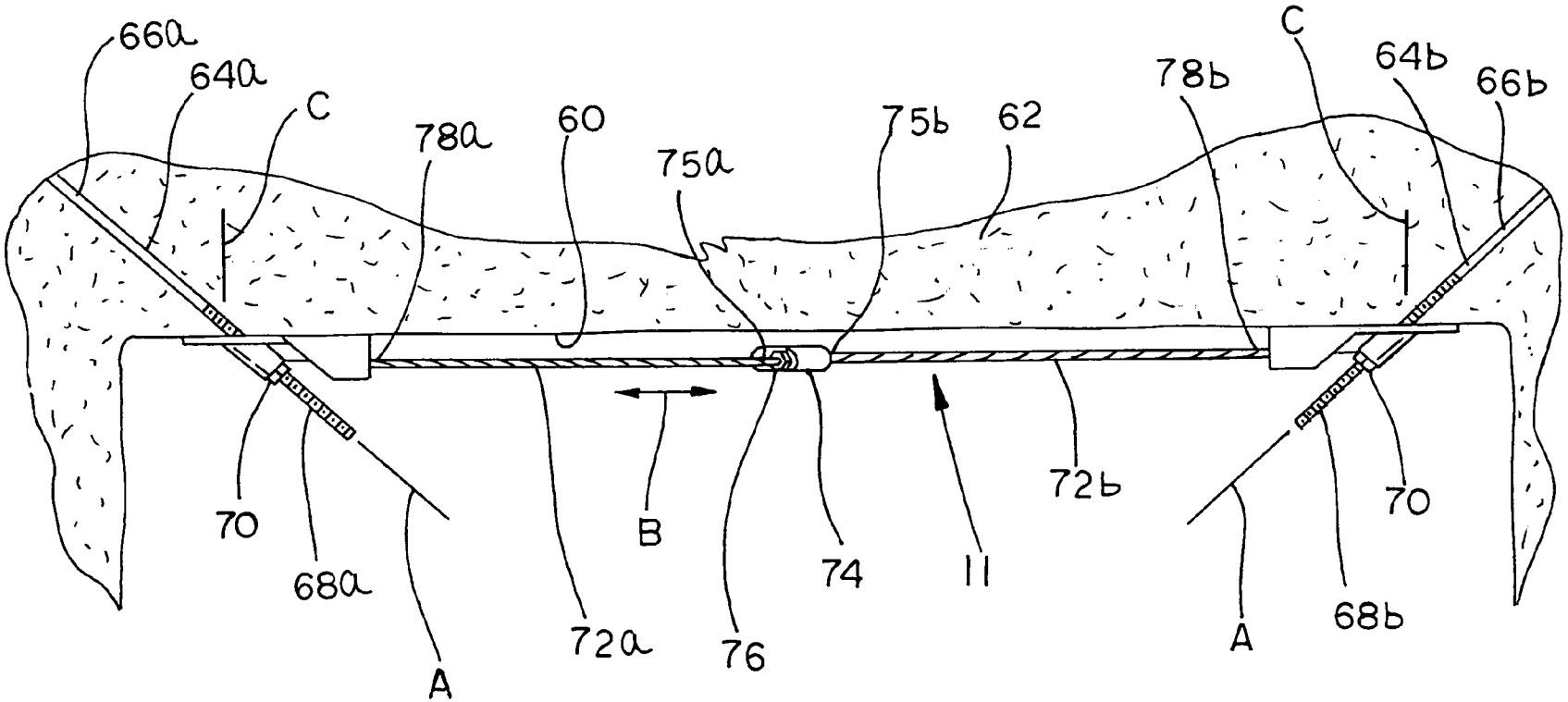
FIG. 8 is an elevation all view of a roof truss shown in place in a mine roof.
Figure 9:
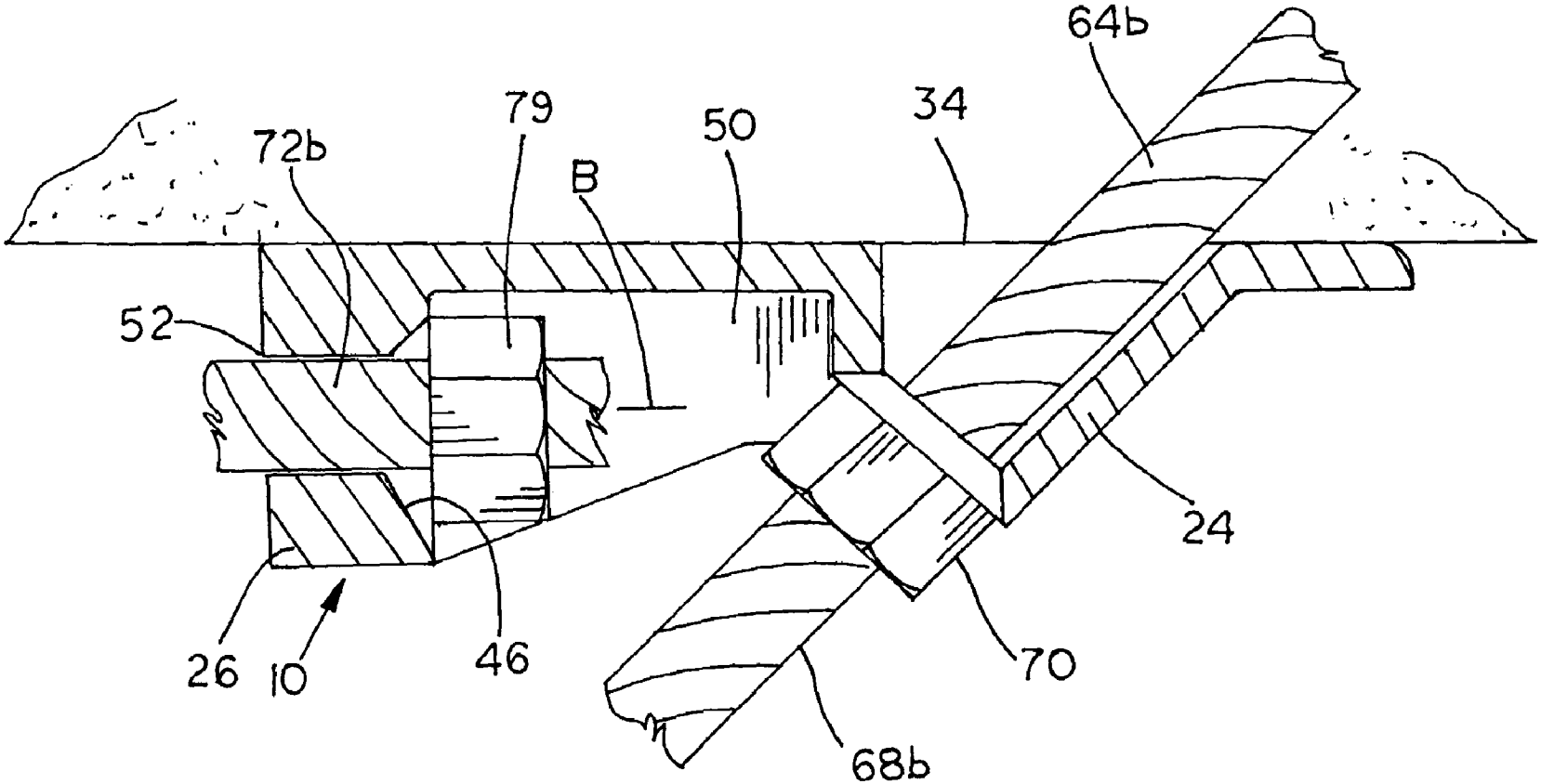
FIG. 9 is a cross-sectional view of a truss shoe shown in place in a mine roof truss.

Referring now to FIGS. 7 and 8, a pair of truss shoes 10 are shown in spaced apart arrangement and disposed generally adjacent a roof 60 of a mine 62 to form a roof truss 11. Each of the truss shoes 10 is attached to a corresponding inclined roof bolt the 64*a* and 64*b*. Each of the roof bolts may be of a conventional roof bolt of the type commonly employed in the art, with each of the roof bolts 64*a*, 64*b* including an anchored portion 66*a*, 66*b*, respectively. The anchored portions 66*a*, 66*b* of each bolt 64*a*, 64*b* may be anchored to the surrounding rock (i.e. the roof 62) using cement, epoxy resin, a mechanical expansion shell, or any other suitable means of securement. Each of the bolts 64*a*, 64*b* also includes an exposed end 68*a*, 68*b*, with each exposed end having a retaining nut 70 (FIG. 9). Preferably, each retaining nut 70 may be generally rounded or otherwise formed to correspond to the shape of the seat 30 (FIG. 6) on each of the truss shoes 10. Alternatively, the retaining nuts 70 may be provided with a washer sized to correspond to the shape of the seat 30.

Figure 10A:
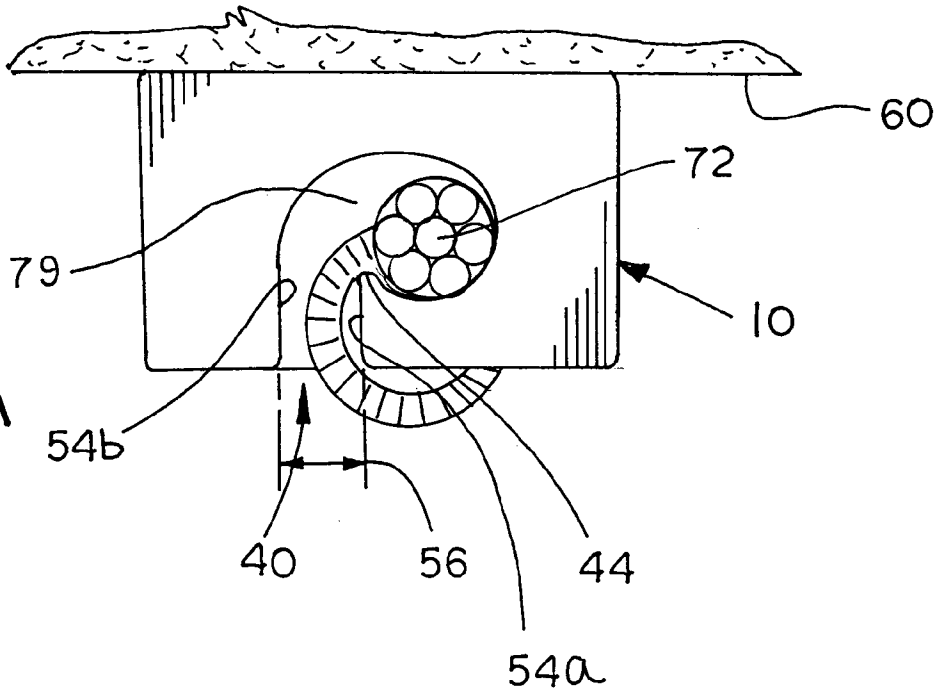
FIG. 10A is an end view of the truss shoe taken along line 10—10 of FIG. 9.

Referring to FIG. 8, a cross member 72 having a first part 72*a* and a second part 72*b* extends between the spaced apart truss shoes 10. In the disclosed example, the first and second parts 72*a* and 72*b* are joined together by a central coupler 74. Each of the first and second parts 72*a* and 72*b* is preferably threaded or otherwise constructed to receive suitable fasteners such that, in the disclosed example, each of the first and second parts 72*a* and 72*b* can be tensioned at the central coupler 70. In the disclosed example, each part 72*a* and 72*b* includes an inner end 75*a*, 75*b*, respectively, that is joined to the central coupler 70 using hex nuts 76 or other suitable fasteners. Each of the first and second parts 72*a* and 72*b* also includes an outer end 78*a* and 78*b*, respectively, with the outer ends 78*a* and 78*b* being attached to a corresponding one of the shoes 10 using for example, a pre-fixed terminal end 79 (FIG. 9 and FIG. 10A). Alternatively, the terminal end 79 may be either a nut or a threaded cross member or a fixed end similar to a barrel and wedge on a cable cross member. It will be appreciated when viewing FIG. 9 that the space 50 between the stanchion 24 and the retaining bracket 26 is large enough to accommodate the appropriate end of the cross member 72 and the exposed ends 68*a* and 68*b* of the inclined roof bolts 64*a* and 64*b* without interference between the cross member and the inclined bolt.

Figure 10B:
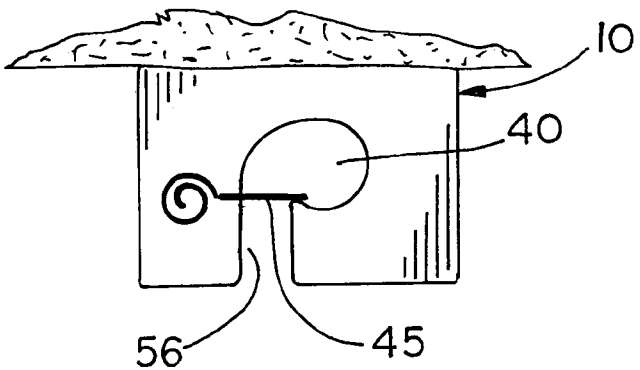
FIG. 10B is an end view similar to FIG. 10A but illustrating an optional spring clip disposed adjacent the J-shaped bore.
Figure 13:
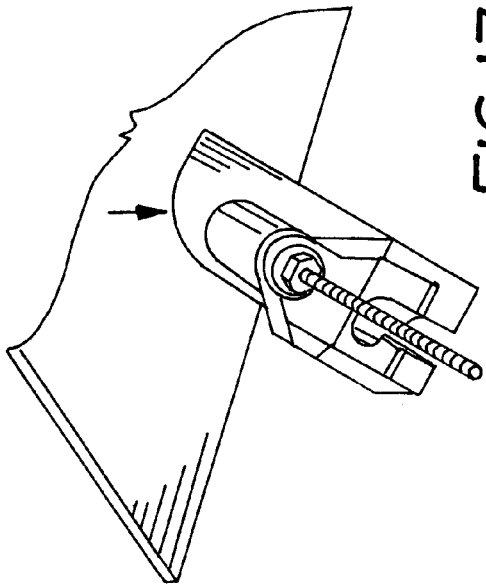
FIGS. 11–17 illustrate one manner of installing a truss shoe when forming a roof truss, and illustrating the truss shoe self-rotating between a first position (FIG. 11) and a second position (FIG. 17) in response to tensioning the inclined roof bolt.
Figure 12:
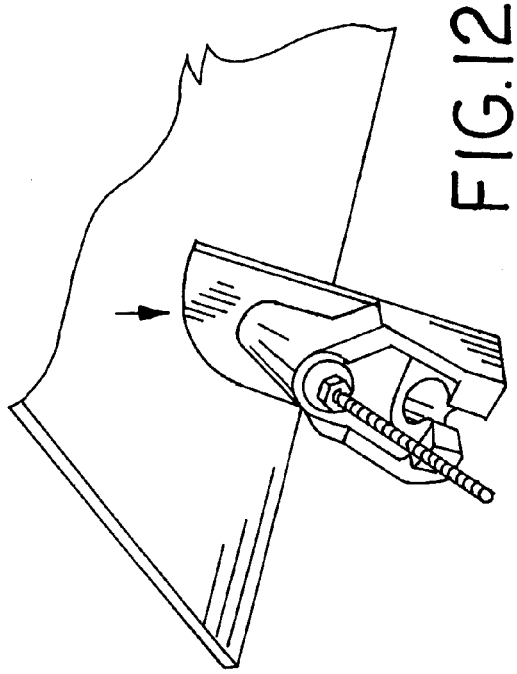
Figure 11:
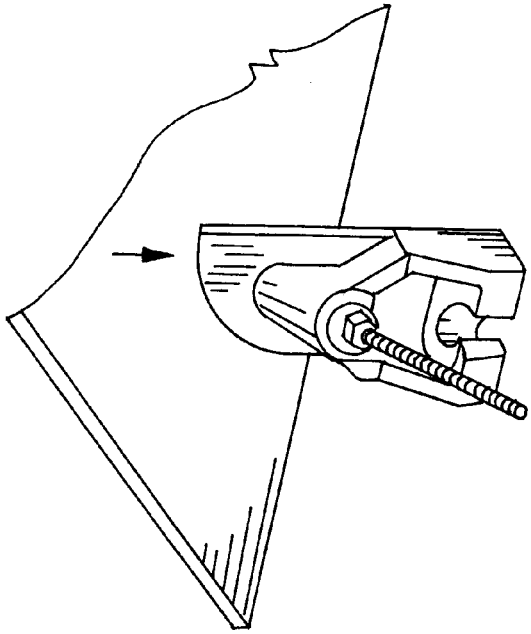
Figure 15:
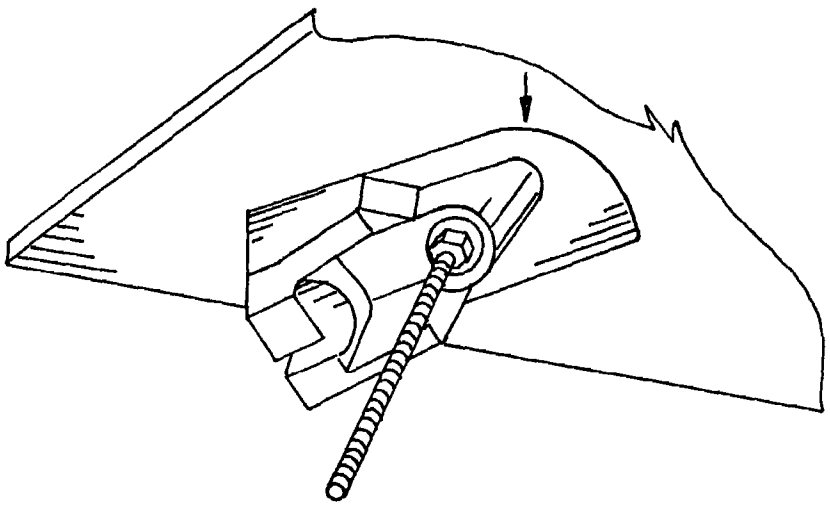
Figure 14:
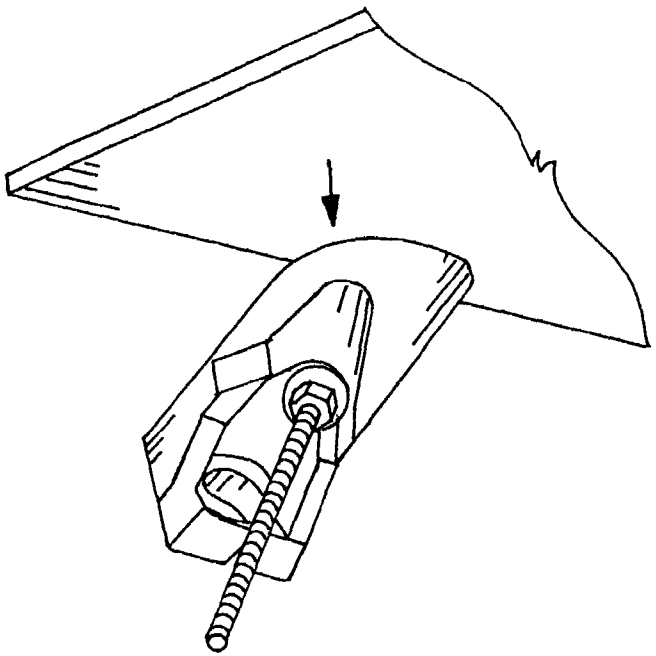

Referring now to FIG. 10A, the truss shoe 10 is shown with the bearing surface of the bottom side 14 facing upwardly and in contact with the roof 60 of the mine 62. The shank of the horizontal bolt 72 is shown disposed in the J-shaped bore 40. It will be understood that the horizontal bolt 72 may be placed into the bore 40 by manipulating the shank of the bolt 72 in a generally upward direction through the gap 56 defined by the opposed faces 54*a* and 54*b*. The shank of the bolt 72 will be retained as shown due to, at least in part, the presence of the retaining lip 44. The retention provision of the retaining lip 44 may be enhanced by providing a mounted spring clip 45 as shown in FIG. 10B. The spring clip 45 opens in order to allow passage of the end of the cross member, and then closes to prohibit the cross member to slip back out of the J-slot 40. Thus the spring clip 45 serves as a gate. Accordingly, the a bolt 72 will stay positioned as shown regardless of whether the bolt 72 has been tensioned at the coupler 74 using the hex nuts 76.

Figure 17:
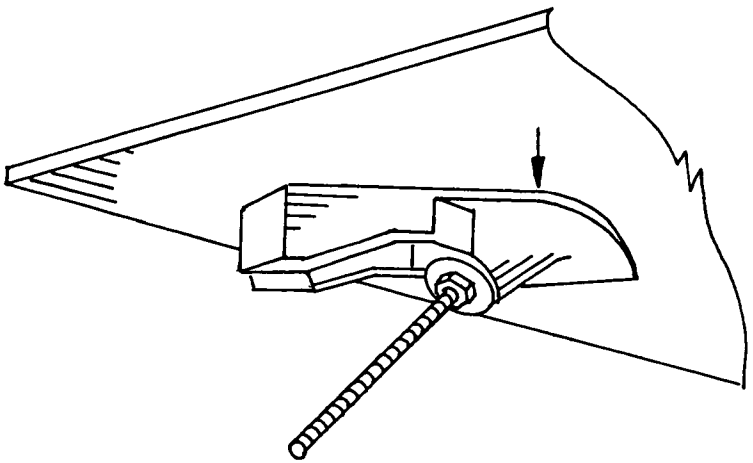
Figure 16:
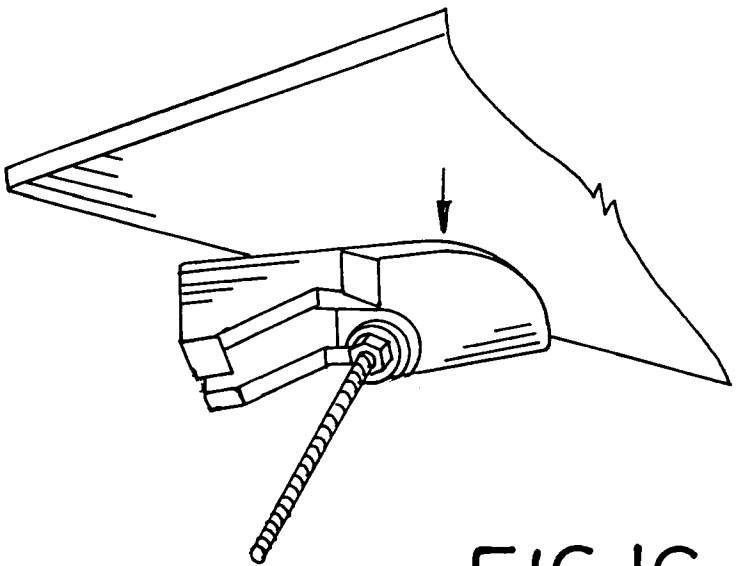

Referring now to FIGS. 11–17, one manner of installing the truss shoe 10 is shown. In a first position, the truss shoe 10 is positioned with the edge 16*a* on the end 16 in abutment with the mine roof 60 or in abutment with the mine roof 60. The exposed end 68*a* of the inclined roof bolt 64*a* is shown prior to tensioning the bolt 64*a* by tightening the hex nut 70. As the roof bolt 64*a* is inserted into the bore hole using, for example, right-hand rotation and thrust, the bolt is then tensioned using, by way of example rather than limitation, a conventional bolting machine (not shown). Thus, it will be appreciated that the truss shoe 10 will shift along the curved surface 23, aided, at least in part, by the chamfered edges 16*b*, 20*b* and/or 23*b*. Thus, the truss shoe 10 may shift and/or rotate gradually as the inclined roof bolt 64*a* is tensioned by rotating the nut 70, which permits the truss shoe 10 to end up as shown in FIG. 17 tightened against the mine roof, with the bearing surface on the bottom side 14 in abutment with the mine roof. The position of the truss shoe 10 as depicted in FIG. 17 is such that the installing mine operator does not have to directly manipulate the truss shoe 10 significantly before installing the cross member. It is understood, that the truss shoe 10 depicted with the curved edge 23 is designed for use with right-hand rotation during installation of the inclined bolt. For a left-hand installation the curved edge 23 would have to be mirror flipped on the truss shoe 10. Further, and with reference to FIG. 8, as the horizontal bolt 72 is tensioned, the truss shoe 10 is free to rotate slightly about a generally vertical axis C, such that, upon tensioning the horizontal bolt 72 as discussed above the truss shoe 10 will be brought into a desired position with the end 18 and the retaining bracket 26 disposed inwardly generally facing the central coupler 74. In all other respects, conventional and well excepted installation steps and procedures may be followed.

A mine roof truss assembled in accordance with teachings of the invention may thus comprise of a pair of spaced apart inclined bolts joined to a pair of ends of a tensionable cross member coupled at a central coupler to allow for tensioning. The inclined bolts may be installed with the truss shoe such that the shoe will self-rotate into a position suitable to connect the shoe to the cross member. The cross member may be connected to the truss shoe from a safe operator position by swinging the terminal end of the cross member through the J-shaped slot into a retained position in the truss shoe. The cross member may be retained therein by the lip formed in the J-slot and, optionally, by a spring clip attached to the truss shoe. The retention provision does not require tension in the cross member which significantly facilitates the installation of the truss as well as secures the cross member in the event the tension in the cross member drops during use of the truss.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed:

1. A truss shoe for use on a mine roof truss having at least one inclined bolt and at least one horizontal bolt, the truss shoe comprising:

a base, the base including a first end, a second end, a first side and a second side extending between the first and second ends, a generally planar bearing surface, and a top side disposed opposite the bearing surface, the bearing surface arranged for contact with the mine roof;

a stanchion formed on the top side, the stanchion including a bore extending from a top end of the stanchion through the bearing surface, the bore sized to receive the inclined bolt;

a bracket formed on the top side, the bracket including a laterally extending open slotted bore sized to receive the horizontal bolt; and a portion of the first end and a portion of the first side cooperating to form a curved edge.

2. The truss shoe of claim 1, wherein the top end of the stanchion includes a recessed seat.

3. The truss shoe of claim 2, wherein the seat is generally conical.

4. The truss shoe of claim 2, wherein the seat is generally spherical.

5. The truss shoe of claim 1, wherein the bore of the stanchion is disposed at an angle relative to a plane of the bearing surface.

6. The truss shoe of claim 5, wherein the slotted bore of the bracket includes an axis disposed generally parallel to the plane of the bearing surface.

7. The truss shoe of claim 6, wherein the slotted bore of the bracket is generally J-shaped.

8. The truss shoe of claim 7, wherein the slotted bore of the bracket includes a recessed seat.

9. The truss shoe of claim 8, wherein the seat of the slotted bore is generally spherical.

10. The truss shoe of claim 6, wherein the slotted bore includes a retaining lip.

11. The truss shoe of claim 1, wherein the bore of the stanchion terminates in a slot formed on the bearing surface.

12. A truss shoe for use on a mine roof truss having at least one inclined bolt and at least one horizontal bolt, the truss shoe comprising:

a base, the base including a first end, a second end, a curved side, a generally planar bearing surface, and a top side disposed opposite the bearing surface, the bearing surface arranged for contact with the mine roof;

a stanchion formed on the top side, the stanchion including an angled bore having a top end and a bottom end, the bottom end of the bore extending through the bearing surface, the bore sized and positioned to receive the inclined bolt; and a retaining bracket formed on the top side and spaced away from the stanchion, the retaining bracket including a J-shaped bore having an open slot, the bore and the slot both sized to receive the horizontal bolt.

13. The truss shoe of claim 12, wherein the top end of the angled bore includes a recessed seat.

14. The truss shoe of claim 13, wherein the lower end of the angled bore terminates in a slot formed on the bearing surface.

15. The truss shoe of claim 12, wherein the slotted retaining bracket includes a recessed seat defining an axis, and wherein the axis of the recessed seat is disposed generally parallel to a plane of the bearing surface.

16. The truss shoe of claim 12, wherein the slot in the retaining bracket has a generally J-shaped aperture.

17. The truss shoe of claim 16, wherein aperture includes a recessed seat.

18. The truss shoe of claim 12, wherein the slotted retaining bracket includes a lip.

19. The truss shoe of claim 16, wherein the J-shaped aperture includes a retaining lip formed adjacent a recessed seat.

20. A system for forming a mine roof truss comprising:

a pair of spaced apart inclined bolts;

a horizontal bolt having a pair of ends;

a pair of truss shoes, each of the truss shoes including:

a base, the base including a first end, a second end, a continuous first side and a continuous second side extending between the first and second ends, wherein one of the first and second sides is curved and exclusively convex side, a generally planar bearing surface, and a top side disposed opposite the bearing surface, the bearing surface arranged for contact with the mine roof;

a stanchion formed on the top side, the stanchion including an angled bore having a top end and a bottom end, the bottom end of the bore extending through the bearing surface; and a slotted retaining bracket formed on the top side and spaced away from the stanchion;

the stanchion of each of the truss shoes receiving a corresponding one of the inclined bolts;

the retaining bracket of each of the truss shoes receiving a corresponding one of the ends of the horizontal bolt; and whereby the roof truss is formed upon tensioning each of the inclined bolts and upon tensioning the horizontal bolt.

21. The system of claim 20, wherein the horizontal bolt comprises two sections, and further including a coupler for joining the two sections.

22. The system of claim 20, wherein the curved side of each of the truss shoes is arranged to contact the mine roof prior to tensioning the inclined bolts.

23. The system of claim 20, wherein the bottom end of the angled bore and the bearing surface cooperate to permit the truss shoe to pivot about an axis disposed perpendicular to the bearing surface.

24. The system of claim 20, wherein the top end of the bore includes a recessed seat arranged to permit angular variations of the inclined bolt relative to the truss shoe, and wherein the bracket includes a recessed seat arranged to permit angular variations of the horizontal bolt relative to the truss shoe.

25. The system of claim 20, wherein the bottom end of the angled bore terminates in a slot formed on the bearing surface.

26. The system of claim 20, wherein the slotted retaining bracket comprises a J-shape aperture and includes a spring clip disposed adjacent the aperture.

27. The system of claim 20, wherein the first end of the truss shoe includes an edge adapted to bear against the mine roof when the truss shoe is in a first position with the bearing surface disposed generally perpendicular to the mine roof, and wherein the curved surface and the edge are arranged to permit the truss shoe to shift from the first position to a second position in which the bearing surface is disposed parallel to the mine roof in response to tensioning of the inclined bolt.

28. A method of forming a mine roof truss comprising the steps of:

inserting a pair of spaced apart inclined bolts into the mine roof;

providing a cross member having a pair of ends;

providing a horizontal bolt having a pair of ends:

providing a truss shoe for each of the roof bolts, each of the truss shoes including:

a base, the base including a first end, a second end, a continuous first side and a continuous second side extending between the first and second ends, wherein one of the first and second sides is curved, a generally planar bearing surface, and a top side disposed opposite the bearing surface, the bearing surface arranged for contact with the mine roof;

a stanchion formed on the top side, the stanchion including an angled bore having a top end and a bottom end, the bottom end of the bore extending through the bearing surface; and a retaining bracket formed on the top side and spaced away from the stanchion, the retaining bracket including an open bore having a slot defining a gap sized to receive the horizontal bolt;

placing an exposed end of each inclined bolt through the stanchion of a corresponding one of the truss shoes and positioning the truss shoe in a first position with the bearing surface perpendicular to the mine roof;

tensioning each of the inclined bolts to cause each truss shoe to automatically shift to a second position in which the bearing surface is parallel to the mine roof;

positioning each end of the horizontal bolt in the retaining bracket of a corresponding truss shoe by placing the horizontal bolt through the slot and into the bore; and tensioning the cross member to form the roof truss.

29. The method of claim 28, wherein the cross member comprises two sections, and comprising the steps of joining the two sections using a coupler, and tensioning the cross member using a hydraulic tensioning unit.

30. The method of claim 29, including providing a terminal end on each of the sections, and placing the end of each section in a recessed seat, the recessed seat formed in the slotted retaining bracket of a corresponding one of the truss shoes.

31. The method of claim 28, including providing a retaining a lip on the slotted retaining bracket.

32. The method of claim 31, including providing a J-shaped aperture in the slotted retaining bracket.

33. The method of claim 28, wherein the bottom end of the angled bore terminates in a slot formed on the bearing surface.

34. The method of claim 28, including shaping the curved side such that the truss shoe shifts from the first position to the second position along the curved side.

* * * * *

UNITED STATES PATENT AND TRADEMARK OFFICE

CERTIFICATE OF CORRECTION

PATENT NO. : 7,118,310 B2
APPLICATION NO. : 10/725895
DATED : October 10, 2006
INVENTOR(S) : Alexander I. Wallstein et al.

It is certified that error appears in the above-identified patent and that said Letters Patent is hereby corrected as shown below:

On the Title Page:

Item (74), "Borum" should be -- Borun --.

At Column 6, line 22, "convex side" should be -- convex --.

At Column 8, lines 18-19, "retaining a lip" should be -- retaining lip --.

Signed and Sealed this

First Day of May, 2007

JON W. DUDAS
*Director of the United States Patent and Trademark Office*